US005312143A

United States Patent [19]

Buckner

[11] Patent Number: 5,312,143

[45] Date of Patent: May 17, 1994

[54] EARTHQUAKE SAFETY CABINET LATCH

[76] Inventor: Almar W. Buckner, 3656 Las Flores Canyon Rd., Malibu, Calif. 90265

[21] Appl. No.: 979,162

[22] Filed: Nov. 19, 1992

[51] Int. Cl.[5] ..... E05C 3/12

[52] U.S. Cl. ..... 292/230; 292/336; 292/DIG. 22

[58] Field of Search ..... 292/336, 130, 183, 230, 292/121, DIG. 22, DIG. 62, DIG. 65, 333, 332

[56] References Cited

U.S. PATENT DOCUMENTS 3,918,752 11/1975 Leone et al. ..... 292/DIG. 65 X
4,306,431 12/1981 Craig ..... 292/DIG. 65 X
5,035,451 7/1991 Brady ..... 292/DIG. 22 X

FOREIGN PATENT DOCUMENTS 326901 8/1970 Sweden ..... 292/DIG. 22

*Primary Examiner*—Rodney M. Lindsey
*Attorney, Agent, or Firm*—Natan Epstein

[57] ABSTRACT

A tremor actuated cabinet door latch has a spring loaded arm held back by a weighted trip pin. The pin releases the arm in response to shaking of the cabinet, allowing the arm to engage a catch mounted on the cabinet door, to keep the door from swinging open during an earth tremor.

16 Claims, 2 Drawing Sheets

Fig. 3
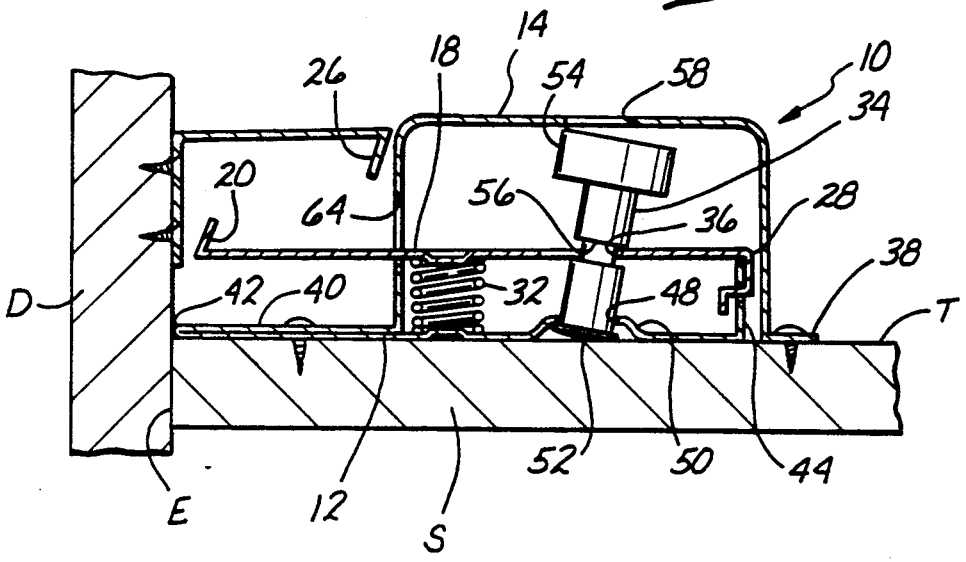
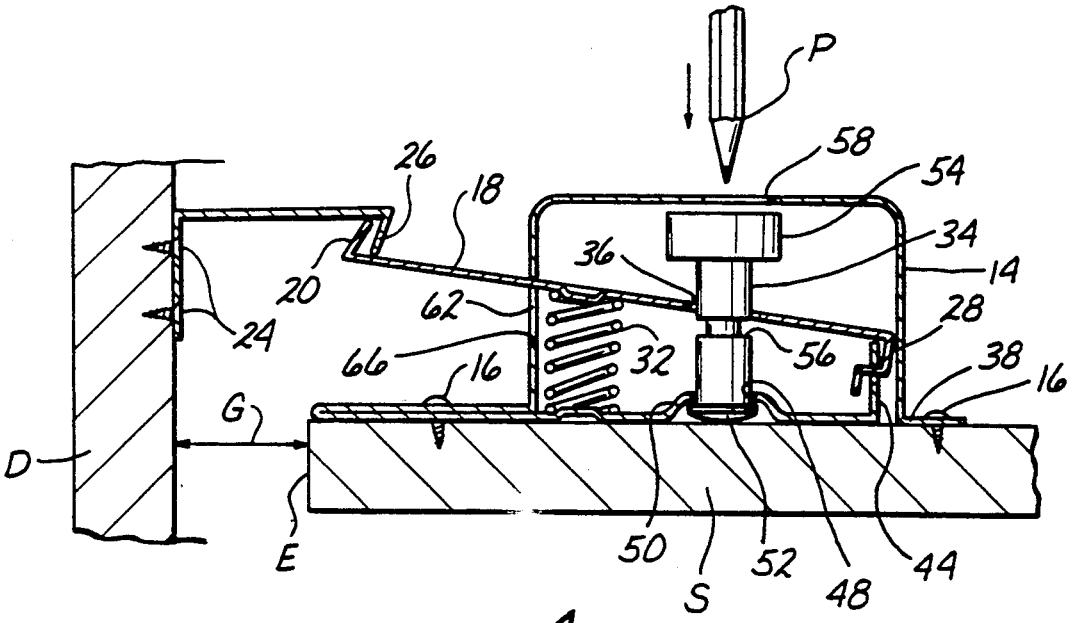
Fig. 4

EARTHQUAKE SAFETY CABINET LATCH

BACKGROUND OF THE INVENTION

1. Field of the Invention

This invention relates generally to the field of earthquake preparedness and safety and more particularly relates to a mechanical device for installation in cabinets or the like with the objective of securing the door of the cabinet in the event of an earth tremor to keep the contents of the cabinet from spilling out.

2. State of the Prior Art

Many latching or locking devices are known for securing cabinet doors in a closed position. These latching devices, however, require manual operation and are in either a locked or an unlocked condition. Such conventional locks are not helpful in circumstances where the entire cabinet is physically disturbed, upset or shaken as occurs during an earthquake. During such a tremor occupants of a house cannot be relied upon to secure cabinet doors, and it may in fact be dangerous for them to approach an open cabinet, the contents of which may be about to spill out.

What is needed is a simple latching or locking mechanism which can be easily installed in existing cabinets and which under normal circumstances will not interfere with access to the cabinet, but will respond to any significant disturbance of the cabinet by latching the cabinet door against opening until the disturbance has passed. Such a device should also be easy to reset to its stand-by condition after it has been actuated.

Such disturbance responsive door latches can also find application in cabinet installations in vehicles such as motor homes and boats, among others.

U.S. Pat. No. 5,035,451 issued to Bradey discloses a disturbance responsive magnetic latch which addresses the aforementioned need. This prior art device relies on small permanent magnets attracting a movable latch element when disturbed.

The applicant is unaware of any existing disturbance responsive door latches which are entirely of a mechanical design and do not depend on magnetic attraction.

SUMMARY OF THE INVENTION

A mechanical latch which is responsive to tremors and useful for securing cabinet doors in case of an earthquake comprises a base for mounting to a stationary surface in the cabinet, an arm hinged at one end to the base and having an opposite free end, a spring normally urging the arm towards an elevated position relative to the base, and a trip pin normally restraining the arm in a retracted position against the urging of the spring. The trip pin is constructed and mounted to the base so as to move out of engagement with the arm in response to disturbance of the cabinet surface and thereby release the arm towards its elevated position. A catch is mounted on a surface of the cabinet door and is engaged by the free end of the arm when the latter is released in response to a tremor or similar disturbance of the cabinet. This engagement between the latch arm and the door mounted catch restraints the cabinet door from swinging open during the tremor. The length of the arm is such as to permit a small opening between the door and the cabinet sufficient to allow access of fingers or a small tool for disengaging the arm from the catch and allow the door to be opened after the disturbance subsides.

The trip pin has a lower end pivotably supported to the base, a relatively heavy free upper end and a detent located intermediate the two ends. The arm is restrained in its retracted position by engagement with the detent.

In a presently preferred form of the invention, the lower end of the pin is loosely set in a nipple formed in the base, and is retained against separation from the nipple by a round rivet head on the lower end and captive in the nipple. The arm may be of sheet metal and has an opening between its opposite ends. The pin extends through this opening and has a weight attached to its upper end. The detent may be in the form of a circumferential groove formed in the pin at a location engageable with an edge of the opening in the arm. The arrangement is such that a shaking or tilting of the mounting surface of the mechanism causes the weighted upper end of the pin to swing, taking the detent on the pin out of engagement with the arm, which is then free to respond to the urging of the spring by moving to its elevated position, where it is held by the spring force until the device is manually reset.

It is preferred to provide a housing on the base to enclose the trip pin and part of the arm, in order to prevent the device from being accidentally tripped. The housing may have an opening through which extends the arm, the opening being sized so as to limit movement of the arm at least at the elevated position. The base may have a forward edge arranged such that the arm is properly positioned for engagement with the catch by mounting the base on the stationary cabinet surface with the forward edge of the base at or near the edge of the stationary cabinet surface adjacent to the cabinet door surface. The free end of the arm and the catch may each have oppositely curved, hooked portions which are mutually engageable in the elevated position of the arm for restraining the cabinet door against opening.

These and other features, improvements and advantages of the present invention will be better understood from the following description taken in conjunction with the accompanying drawings.

BRIEF DESCRIPTION OF THE DRAWINGS

FIG. 3 is a vertical section of the installation of FIG. 1 taken along line 3—3, the arm being set in its retracted position by engagement with the trip pin;

FIG. 4 is a view as in FIG. 3 with the arm shown in its released condition and engaged to the catch on the cabinet door, and also illustrating use of a pencil as a tool for engaging the trip pin to reset the safety latch.

DETAILED DESCRIPTION OF THE PREFERRED EMBODIMENT

Figure 1:
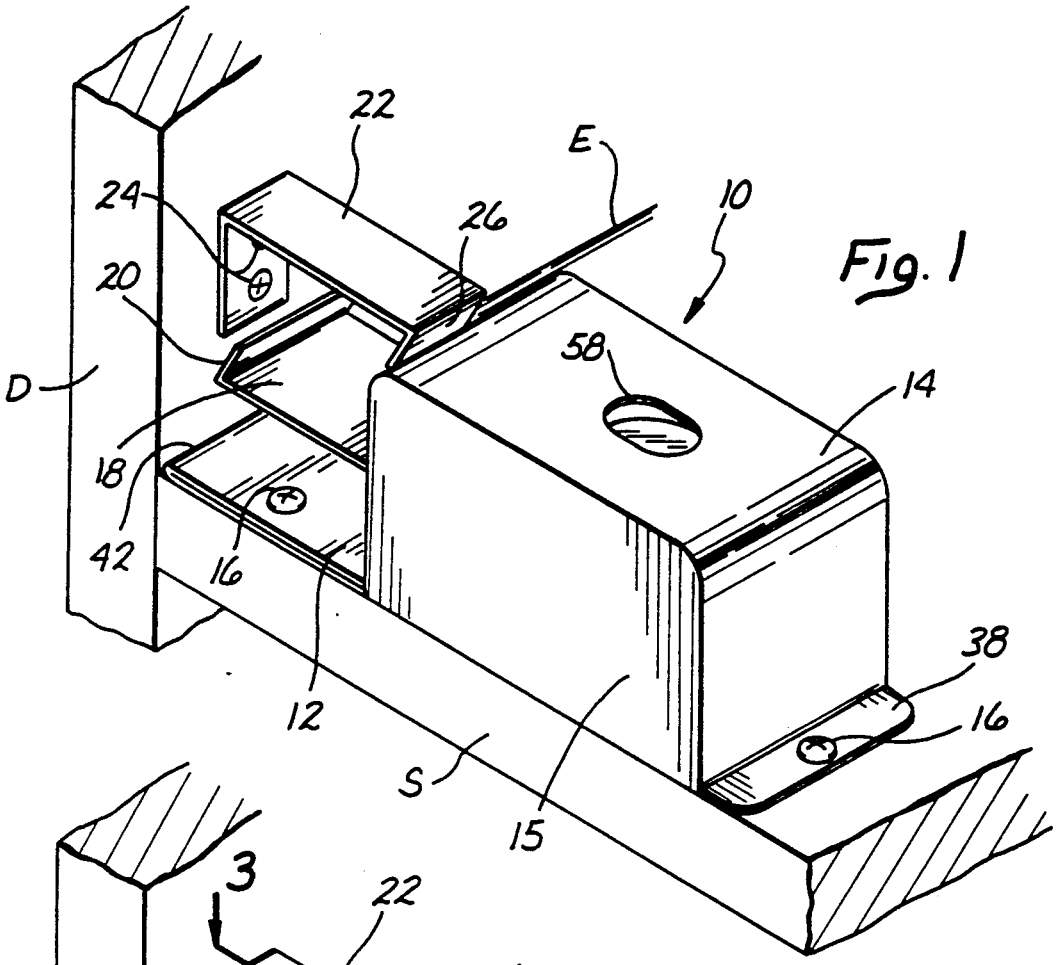
FIG. 1 is a perspective view of the safety latch of this invention shown in a typical cabinet installation, the cabinet being broken away and shown only in relevant part.
Figure 2:
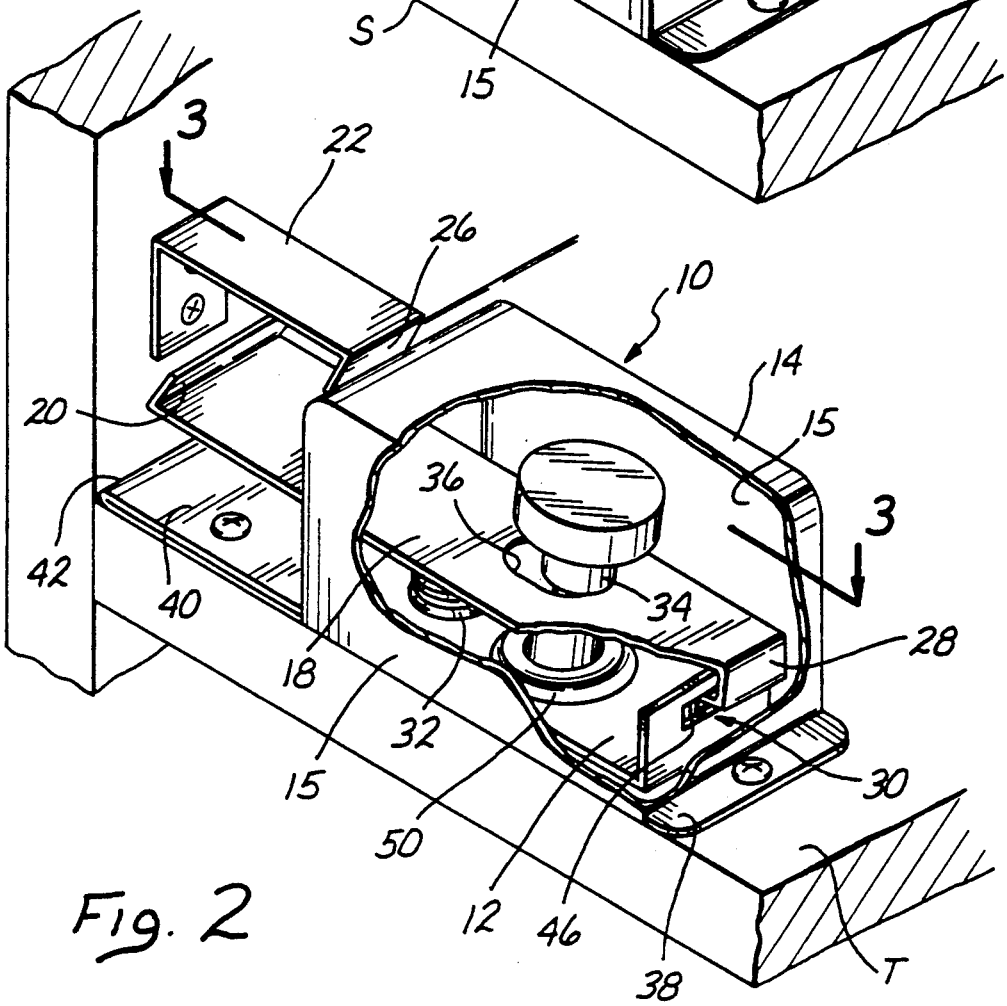
FIG. 2 is a view as in FIG. 1 but with the latch housing broken away to show the tremor responsive trip mechanism.

With reference to the accompanying drawings, FIG. 1 shows the earthquake safety cabinet latch of this invention, designated generally by numeral 10, installed in a storage cabinet of conventional design, which is shown only in relevant part as including a stationary shelf S, which may also be the bottom or top of the cabinet, and a movable door D which is hinged to the cabinet at an edge not shown in the drawing so as to swing away from the edge E of the shelf S. In FIGS. 1 through 3, the cabinet door D is shown closed so that its inner surface lies against the edge E of the shelf.

The safety latch 10 has a base 12 formed from sheet metal or high impact plastic, housing 14 of formed plastic, and which is fastened to the shelf S by means of screw fasteners 16. An arm 18 extends from the housing 14 and has a hooked free end 20 bent upwardly. A catch 22 is mounted to the door D by screw fasteners 24 and has a hooked free end 26 bent downwardly, towards the arm 18.

Turning to FIG. 2, the housing 14 is broken away to show the arm 18 with an inner end 28 hinged at 30 to the base 12, a coil spring 32 compressed between the base 12 and an intermediate location of the arm 18, and a trip pin 34 engaged to the edge of opening 36 in the arm 18 for restraining the arm 18 in a retracted position against the upward urging of the spring 32. The interior arrangement of the latch mechanism is better understood by reference to FIG. 3. The base 12 has a vertical tab 44 at its rearmost end, and folds back at a forward edge 42 in a top section 40 which is continuous with the housing 14 and rear flange 38. The side walls 15 of the housing 14 are also integral with the top of the housing and the base 12, the inner end 28 of the arm is bent first downwardly, then forwardly and again downwardly and is inserted into slot 46 in the tab 44, as shown in FIGS. 2 and 3, in a hinge arrangement 30 which permits the arm 18 to pivot in a vertical plane relative to the base 12. The arm 18 extends through a front opening 62 in the housing 14. The opening 62 has an upper edge 64 and a lower edge 66 which limits the movement of the arm 18 in the vertical plane at an elevated position and a retracted position respectively of the arm.

The trip pin 34 has a lower end set loosely in the opening 48 of a raised nipple 50 formed in the base 12. The lower end of the pin is retained against withdrawal from the nipple opening by a rivet or flat head 52 which is captive in the nipple 50. The nipple opening 48 is oversized relative to the diameter of the trip pin 34 to allow free pivotal movement of the pin on the shelf surface T. The bottom surface of the rivet head 52 is convexly dished and facilitates rocking or pivoting of the pin 34 on the fixed surface T in response to shaking or similar disturbance of the shelf S.

The upper end of the pin 34 has a weight 54 which makes the pin top heavy and facilitates its pivoting response to any disturbance or shaking of the shelf S.

A detent slot 56 extends circumferentially on the pin 34 at a location intermediate the opposite ends of the pin. The safety latch 10 is set by depressing the free end 20 of the arm 18 to the retracted position shown in FIGS. 1-3, and then retaining the arm in that position by engaging the edge of the opening 36 in the arm within the detent slot 56 of the trip pin 34, as shown in FIG. 2 and 3, thereby holding the arm against the upward urging of the coil spring 32. In the event of an earthquake of significant magnitude, the cabinet and shelf S will be shaken. The tremor is transmitted to the safety latch mechanism 10, causing the pin 34 to rock on head 52, so that the pin is displaced from its retentive engagement with the edge of the arm opening 36, freeing the arm for upward movement in response to the urging of coil 32, to the elevated position of arm 18 shown in FIG. 4. The hooked end 20 of the arm 18 is now just under the horizontal portion of the catch 22 and aligned for engagement with the downwardly curved end 26 of the catch. Such engagement between the oppositely curved ends of the arm 18 and catch 22 occurs, as illustrated in FIG. 4, when the cabinet door D moves away from the edge E of the cabinet shelf S, limiting the opening of the door D to a small gap G sufficient to admit either fingers or a convenient tool for pushing down the arm 18 out of engagement with the catch 22, to free the cabinet door which can then be fully opened. The safety latch 10 is reset by holding down the arm 18 and reengaging the detent slot 56 of the trip pin 34 with an edge of the arm opening 36. The reengagement of the pin 34 may be accomplished by means of a pen or pencil P inserted through a top opening 58 (best seen in FIG. 1) in the top of housing 14. The tip of the pen or pencil P is inserted into hole 58 and the pin is pushed into engagement with the arm 18 by manipulation of the pen or pencil P.

While a particular embodiment of the invention has been described and illustrated for purposes of clarity and example, it must be understood that many changes, modifications, and substitutions to the described embodiment will become apparent to those possessed of ordinary skill in the art without thereby departing from the scope and spirit of the protected invention which is defined by the following claims.

What is claimed is:

1. A tremor actuated mechanism comprising:
a base for mounting to a first surface;
an arm having an end hinged to said base and an opposite free end;
spring means urging said arm towards an elevated position relative to said base;
trip means normally restraining said arm in a retracted position against said urging;
said trip means being arranged and configured to move out of restraining relationship with said arm in response to disturbance of the first surface thereby to release said arm for movement towards said elevated position.

2. The mechanism of claim 1 wherein said trip means comprises a pin having a lower end pivotably supported to said base, a relatively heavy free upper end, and detent means intermediate said lower end and said upper end and engageable with said arm in said restraining relationship.

3. The mechanism of claim 2 wherein said arm has an opening at an intermediate location between said hinged end and said free end, said detent means being engageable to an edge of said opening.

4. The mechanism of claim 3 wherein said detent means comprises a circumferential slot in said pin.

5. The mechanism of claim 1 further comprising a housing mounted to said base and partly enclosing said arm including said trip means, there being an opening in said housing for admitting a tool into engagement with said trip means for reengaging said trip means with said arm in said retracted position.

6. The mechanism of claim 2 wherein said lower end of the pin is loosely set in a nipple formed in said base and said lower end has a head holding the pin against separation from said nipple.

7. The mechanism of claim 1 further comprising a catch for mounting to a second surface for engagement by said free end of said arm in said elevated position, thereby to restrain said second surface against movement away from said first surface.

8. A tremor actuated latch mechanism for latching the door of a cabinet, comprising:
a base for mounting to a first surface in the cabinet;

an arm having an end hinged to said base and an opposite free end;

spring means urging said arm towards an elevated position relative to said base;

a trip pin having a lower end pivotably supported to said base, a free upper end, ad detent mean on said pin engageable with said arm for holding said arm in a retracted position against said urging;

said trip pin being arranged and configured to move out of restraining relationship with said arm in response to disturbance of the first surface thereby to release said arm for movement towards said elevated position.

a housing mounted to said base and enclosing said trip pin, there being an opening in said housing for admitting a tool into engagement with said upper end of said trip pin for reengaging said trip pin with said arm following release from said retracted position; and a catch for mounting to a second surface on the door of the cabinet for engagement by said free end of said arm in said elevated position, thereby to restrain said second surface against movement away form said first surface.

9. The mechanism of claim 8 wherein said lower end of the pin is loosely set in a nipple formed in said base and said lower end has a rivet head holding the pin against withdrawal from said nipple.

10. The mechanism of claim 8 wherein said detent means is engageable with an edge of said arm.

11. The mechanism of claim 8 wherein said free upper end of the trip pin is weighed to make said pin top heavy.

12. The mechanism of claim 10 wherein said detent means comprises a slot in said trip pin.

13. A tremor actuated latch mechanism for latching the door of a cabinet, comprising:

a sheet metal base for mounting to a first surface in the cabinet;

an arm of sheet material having an end hinged to said base and an opposite free end;

a spring compressed between said base and said arm for urging said arm towards an elevated position;

a trip pin extending through an opening in said arm, said pin having a lower end with a head loosely captive in a nipple formed in said base, a weighted free upper end, and a circumferential slot intermediate said lower end and said upper end, said slot engageable with an edge of said opening for holding said arm in a retracted position against said urging;

said trip pin being free to move out of engagement with said arm in response to disturbance of the first surface thereby to release said arm for movement towards said elevated position.

a housing mounted to said base and enclosing said trip pin, there being an opening in said housing for admitting a tool into engagement with said upper end of the trip pin for reengaging said trip pin with said arm following release from said retracted position; and a catch for mounting to a second surface on the door of the cabinet for engagement by said free end of said arm in said elevated position, thereby to restrain said second surface against movement away from said first surface.

14. The mechanism of claim 13 wherein said arm extends through an aperture in said housing, said aperture sized to limit movement of said arm at said retracted and elevated positions.

15. The mechanism of claim 13 wherein said base has a forward edge arranged such that said arm is positioned for engagement with said catch by mounting said base on said first surface with said forward edge near or against said second surface.

16. The mechanism of claim 13 wherein said free end of the arm and said catch have oppositely curved mutually engageable portions.

* * * * *